US009777925B2

(12) United States Patent
Hirata et al.

(10) Patent No.: US 9,777,925 B2
(45) Date of Patent: Oct. 3, 2017

(54) GAS TURBINE COMBUSTOR

(71) Applicant: Mitsubishi Hitachi Power Systems, Ltd., Yokohama, Kanagawa (JP)

(72) Inventors: Yoshitaka Hirata, Yokohama (JP); Shohei Yoshida, Yokohama (JP); Tomoki Uruno, Yokohama (JP); Akinori Hayashi, Yokohama (JP); Hirokazu Takahashi, Yokohama (JP)

(73) Assignee: Mitsubishi Hitachi Power Systems, Ltd., Yokohama (JP)

( * ) Notice: Subject to any disclaimer, the term of this patent is extended or adjusted under 35 U.S.C. 154(b) by 305 days.

(21) Appl. No.: 14/531,156

(22) Filed: Nov. 3, 2014

(65) Prior Publication Data

US 2015/0121879 A1 May 7, 2015

(30) Foreign Application Priority Data

Nov. 5, 2013 (JP) ..... 2013-229510

(51) Int. Cl.
*F23R 3/00* (2006.01)
*F01D 5/18* (2006.01)
(Continued)

(52) U.S. Cl.
CPC ..... *F23R 3/005* (2013.01); *F01D 5/18* (2013.01); *F01D 9/023* (2013.01); *F23R 3/002* (2013.01);
(Continued)

(58) Field of Classification Search
None
See application file for complete search history.

(56) References Cited

U.S. PATENT DOCUMENTS 7,594,401 B1 * 9/2009 Chen ..... F01D 9/023 60/752
2010/0180601 A1 * 7/2010 Ishiguro ..... F23R 3/005 60/755
2015/0107262 A1 * 4/2015 Maurer ..... F01D 9/023 60/785

FOREIGN PATENT DOCUMENTS

EP 0 225 527 A2 6/1987
EP 1 063 388 A2 12/2000
(Continued)

OTHER PUBLICATIONS

Extended European Search Report dated Mar. 10, 2015 (six (6) pages).

*Primary Examiner* — Craig Kim
*Assistant Examiner* — Thuyhang Nguyen
(74) *Attorney, Agent, or Firm* — Crowell & Moring LLP

(57) ABSTRACT

There is provided a gas turbine combustor capable of improving cooling performance of a combustion chamber thereof and reducing the amount of NOx emissions.
The gas turbine combustor includes: a cylindrical combustion chamber that burns combustion air and fuel to thereby produce combustion gas; an outer casing disposed concentrically on an outside of the combustion chamber; an end cover disposed at an upstream side end portion of the outer casing; an annular passage formed by an outer peripheral surface of the combustion chamber and an inner peripheral surface of the outer casing, the annular passage allowing the combustion air to flow therethrough; and a passage formed inside a combustion chamber wall between the outer peripheral surface and an inner peripheral surface of the combustion chamber, the passage having a U-shape turned sideways and having ends disposed on an upstream side in a transverse cross-sectional view, in which the passage includes a first passage that extends in parallel with an axial direction of the
(Continued)

combustion chamber and has a supply hole on a first end side thereof, the supply hole communicating with an outside of the combustion chamber wall, and a second passage that has a second end side communicating with a second end side of the first passage and has a jet hole on a first end side thereof, the jet hole communicating with an inside of the combustion chamber wall.

5 Claims, 7 Drawing Sheets

(51) Int. Cl.

| | |
|---|---|
| ***F01D 9/02*** | (2006.01) |
| ***F23R 3/06*** | (2006.01) |
| ***F23R 3/44*** | (2006.01) |
| ***F23R 3/04*** | (2006.01) |

(52) U.S. Cl.
CPC ..... *F23R 3/04* (2013.01); *F23R 3/06* (2013.01); *F23R 3/44* (2013.01); *F05B 2260/20* (2013.01); *F23R 2900/00012* (2013.01); *F23R 2900/00018* (2013.01); *F23R 2900/03042* (2013.01); *F23R 2900/03043* (2013.01)

(56) References Cited

FOREIGN PATENT DOCUMENTS

| | | | |
|---|---|---|---|
| EP | 1 101 899 | A1 | 5/2001 |
| EP | 1 377 140 | A2 | 1/2004 |
| EP | 2 187 021 | A1 | 5/2010 |
| EP | 2 375 156 | A2 | 10/2011 |
| GB | 2 358 226 | A | 7/2001 |
| JP | 2009-79789 | A | 4/2009 |

* cited by examiner

GAS TURBINE COMBUSTOR

BACKGROUND OF THE INVENTION

1. Field of the Invention

The present invention relates to a gas turbine combustor.

2. Description of the Related Art

In industrial gas turbine combustors, a need exists for reduction in environmental loads and reduction in the amount of nitrogen oxide (NOx) emissions produced from combustion has become one of the major challenges that the industry must face in recent years. The amount of NOx emissions can be reduced by preventing a local high-temperature zone from occurring in the gas turbine combustor. One possible solution is, specifically, to mix fuel and air before the combustion to thereby burn the mixture at a fuel-air mixture ratio lower than a stoichiometric mixture ratio. Thus, increasing the amount of combustion air to thereby reduce the mixture ratio is effective in reducing the amount of NOx emissions.

The gas turbine combustor typically includes a mixer that mixes fuel with air to produce a mixture and a combustion chamber that is disposed downstream of the mixer and burns the mixture. A combustion reaction takes place inside the combustion chamber and thus the combustion chamber wall is exposed to combustion gas at high temperature. Known gas turbine combustors incorporate a film cooling structure that causes part of the combustion air to flow as a film of cooling air along the combustion chamber wall surface.

In general, compressed air supplied from a compressor to a combustor is divided into cooling air for cooling the combustion chamber wall and combustion air. As a result, increasing the amount of the combustion chamber wall cooling air results in a decreased amount of combustion air, which makes it difficult to reduce the amount of NOx emissions. A known method (disclosed, for example, in JP-2009-79789-A) enhances cooling efficiency to reduce the amount of cooling air as follows. Specifically, a path through which cooling air is passed is formed in the combustion chamber wall and the method uses both convection cooling achieved by the cooling air passing through the path and film cooling achieved by air that comes out of the path.

SUMMARY OF THE INVENTION

There has recently been a growing need for greater efficiency in industrial gas turbines to respond to a need for reduction in the amount of carbon dioxide emissions. Efforts are thus being made to increase combustion gas temperatures at the outlet of the combustor (inlet of the gas turbine). As a result, improved cooling performance is becoming a must for the combustor combustion chamber. Meanwhile, the increasing combustion gas temperatures is a cause for increased amounts of NOx emissions, so that the amount of cooling air needs to be reduced in order to increase the amount of combustion air. To solve these problems, the need is to further enhance the cooling performance of the combustor combustion chamber.

The present invention has been made in view of the foregoing situation and it is an object of the present invention to provide a gas turbine combustor capable of improving cooling performance of a combustion chamber thereof and reducing the amount of NOx emissions.

To solve the foregoing problems, an aspect of the present invention incorporates, for example, the arrangements of the appended claims. This application includes a plurality of means for solving the problems. An exemplary aspect of the present invention provides a gas turbine combustor including: a cylindrical combustion chamber that burns combustion air and fuel to thereby produce combustion gas; an outer casing disposed concentrically on an outside of the combustion chamber; an end cover disposed at an upstream side end portion of the outer casing; an annular passage formed by an outer peripheral surface of the combustion chamber and an inner peripheral surface of the outer casing, the annular passage allowing the combustion air to flow therethrough; and a passage formed inside a combustion chamber wall between the outer peripheral surface and an inner peripheral surface of the combustion chamber, the passage having a U-shape turned sideways and having ends disposed on an upstream side in a transverse cross-sectional view, wherein the passage includes a first passage that extends in parallel with an axial direction of the combustion chamber and has a supply hole on a first end side thereof, the supply hole communicating with an outside of the combustion chamber wall, and a second passage that has a second end side communicating with a second end side of the first passage and has a jet hole on a first end side thereof, the jet hole communicating with an inside of the combustion chamber wall, and part of the combustion air that has flowed in through the supply hole flows through the first passage in a direction identical to a flow direction of the combustion gas and thereafter turns back in the second passage to thereby flow in a direction opposite to the flow direction of the combustion gas before jetting out into the inside of the combustion chamber through the jet hole.

The present invention can reduce the amount of cooling air and increase the amount of combustion air because of the improved cooling performance of the combustion chamber in the gas turbine combustor. As a result, the present invention can provide a highly reliable gas turbine combustor capable of reducing the amount of NOx emissions.

BRIEF DESCRIPTION OF THE DRAWINGS

The present invention will be described hereinafter with reference to the accompanying drawings.

DESCRIPTION OF THE PREFERRED EMBODIMENTS

Gas turbine combustors according to preferred embodiments of the present invention will be described below with reference to the accompanying drawings.

First Embodiment

Figure 1:
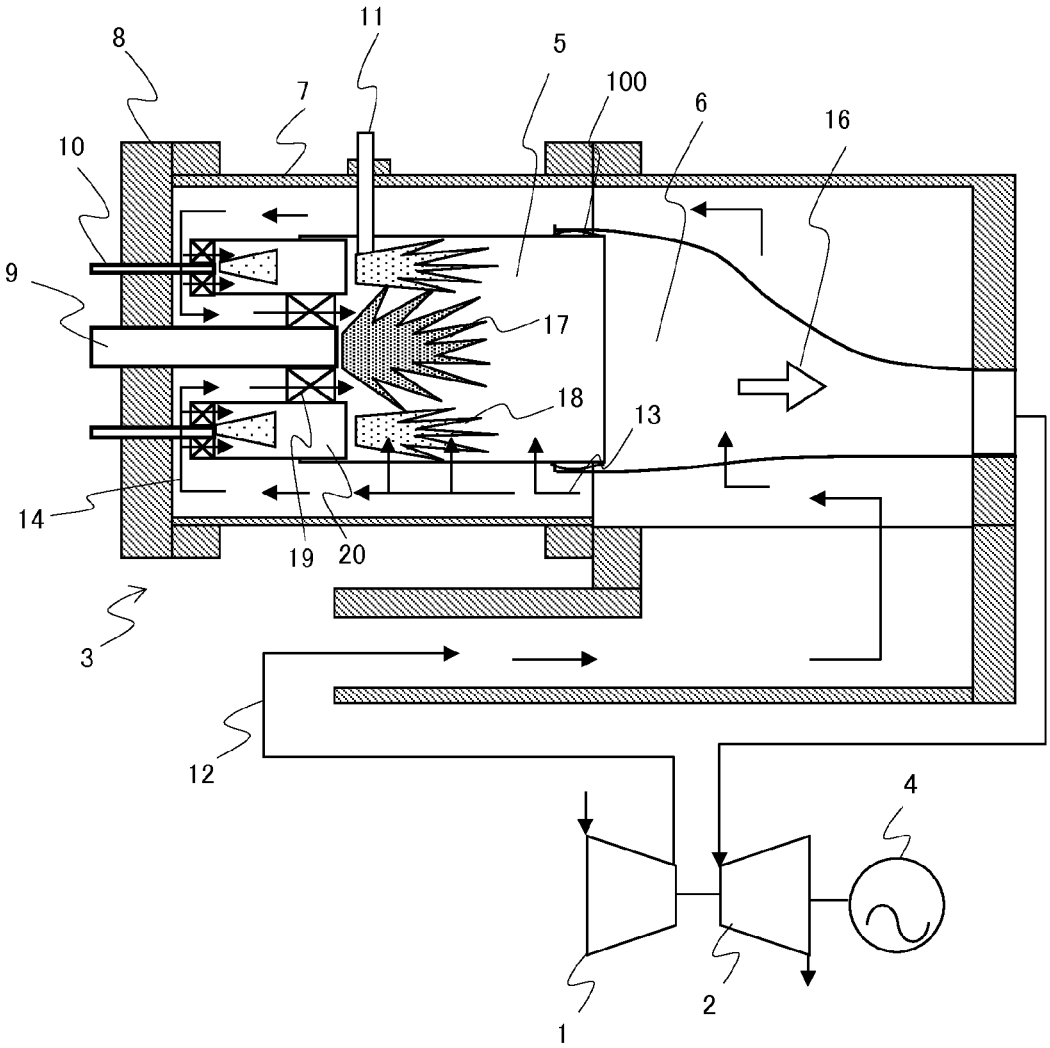
FIG. 1 is a schematic configuration diagram showing generally a gas turbine plant, including a side cross-sectional view of main elements of a gas turbine combustor according to a first embodiment of the present invention.

FIG. 1 is a schematic configuration diagram showing generally a gas turbine plant, including a side cross-sectional view of main elements of a gas turbine combustor according to a first embodiment of the present invention.

The gas turbine plant shown in FIG. 1 mainly includes a compressor 1, a combustor 3, a turbine 2, and a generator 4. The compressor 1 compresses air to thereby produce compressed air 12 at high pressure. The combustor 3 mixes fuel with combustion air 14 allotted from the compressed air 12 introduced from the compressor 1 and burns the resultant mixture to produce combustion gas 16. The turbine 2 receives the combustion gas 16 produced by the combustor 3 and introduced to the turbine 2. The generator 4 is rotatably driven by the turbine 2 to generate electric power. The compressor 1, the turbine 2, and the generator 4 are connected to each other by a rotational shaft.

The combustor 3 includes a combustion chamber 5, a transition piece 6, an outer casing 7, an end cover 8, a diffusion combustion burner 19, and premixed combustion burners 20. The combustion chamber 5 burns the combustion air 14 and fuel to thereby produce the combustion gas 16. The transition piece 6 is disposed downstream of the combustion chamber 5 and connects the turbine 2 and the combustion chamber 5. The outer casing 7 houses therein the combustion chamber 5 and the transition piece 6. The end cover 8 is disposed at an upstream side end portion of the outer casing 7. The diffusion combustion burner 19 and the premixed combustion burners 20 are disposed upstream of the combustion chamber 5. The diffusion combustion burner 19 includes a fuel nozzle 9 and the premixed combustion burners 20 each include a fuel nozzle 10.

At a connection between the combustion chamber 5 and the transition piece 6, the combustion chamber 5 has a downstream side end portion inserted internally in an upstream side end portion of the transition piece 6. The combustion chamber 5 and the transition piece 6 are held in a fit position by a flat spring sealing part 100 disposed on the outer peripheral side of the downstream side end portion of the combustion chamber 5.

The compressed air 12 delivered from the compressor 1 passes through an annular passage formed by the combustion chamber 5, the transition piece 6, and the outer casing 7. Part of the compressed air 12 is used as cooling air 13 for the combustion chamber 5 and the transition piece 6 with the remainder supplied to the diffusion combustion burner 19 and the premixed combustion burners 20 as the combustion air 14. The combustion air 14 is mixed and burned with fuel jetted from the fuel nozzles 9 and 10 disposed in the respective burners. This combustion forms a diffusion flame 17 and premixed flames 18 in the combustion chamber 5.

Figure 2:
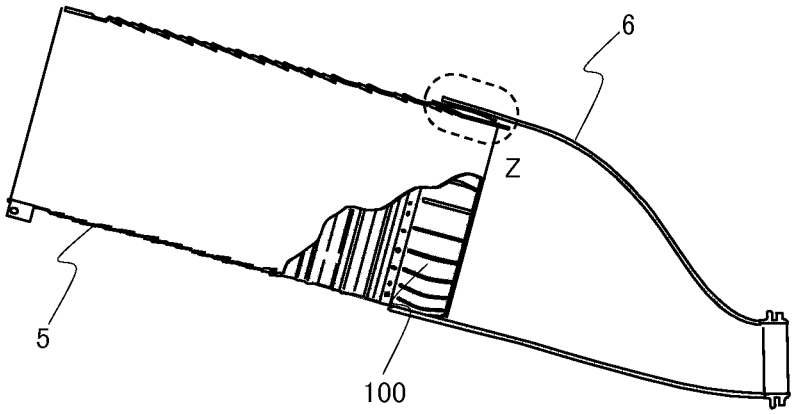
FIG. 2 is a schematic configuration diagram showing an arrangement of a combustion chamber and a transition piece that constitute the gas turbine combustor according to the first embodiment of the present invention.
Figure 3:
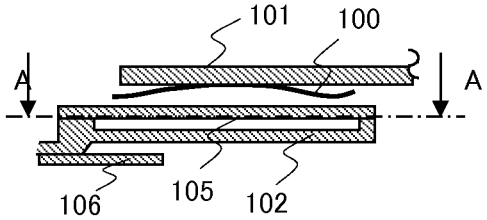
FIG. 3 is an enlarged view of part Z in FIG. 2, assuming a longitudinal cross-sectional view of the combustion chamber and the transition piece.
Figure 4:
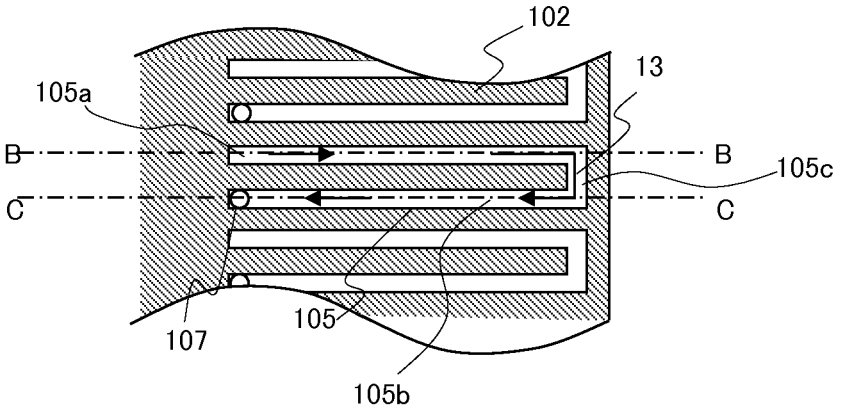
FIG. 4 is a transverse cross-sectional view taken along line A-A in FIG. 3, showing the combustion chamber.
Figure 5:
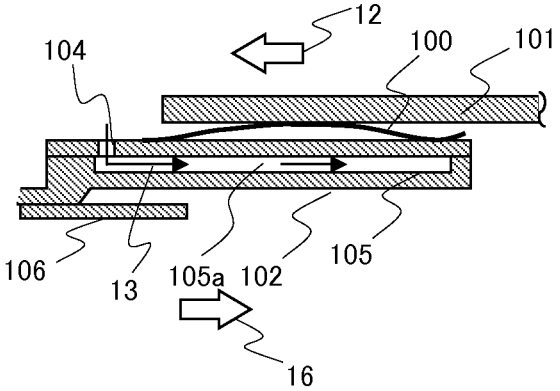
FIG. 5 is a longitudinal cross-sectional view of the combustion chamber and the transition piece, taken along line B-B in FIG. 4.
Figure 6:
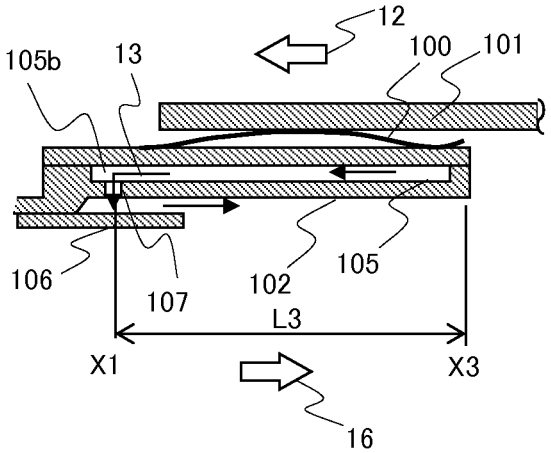
FIG. 6 is a longitudinal cross-sectional view of the combustion chamber and the transition piece, taken along line C-C in FIG. 4.

The following describes a structure of a combustion chamber wall with reference to FIGS. 2 to 6. FIG. 2 is a schematic configuration diagram showing an arrangement of the combustion chamber and the transition piece that constitute the gas turbine combustor according to the first embodiment of the present invention. FIG. 3 is an enlarged view of part Z in FIG. 2, assuming a longitudinal cross-sectional view of the combustion chamber and the transition piece. FIG. 4 is a transverse cross-sectional view taken along line A-A in FIG. 3, showing the combustion chamber. FIG. 5 is a longitudinal cross-sectional view of the combustion chamber and the transition piece, taken along line B-B in FIG. 4. FIG. 6 is a longitudinal cross-sectional view of the combustion chamber and the transition piece, taken along line C-C in FIG. 4. In FIGS. 2 to 6, like or corresponding parts as those shown in FIG. 1 are identified by the same reference symbols and detailed descriptions for those parts will be omitted.

Part Z shown in FIG. 2 is the connection between the combustion chamber 5 and the transition piece 6. As descried earlier, the flat spring sealing part 100 disposed on the outer peripheral side of the downstream side end portion of the combustion chamber 5 retains the fit position between the combustion chamber 5 and the transition piece 6.

FIG. 3 is an enlarged, longitudinal cross-sectional view of the connection between the combustion chamber 5 and the transition piece 6. In FIG. 3, reference numeral 101 denotes a transition piece wall, reference numeral 102 denotes a combustion chamber wall, reference numeral 105 denotes a cooling air passage formed inside the combustion chamber wall 102, and reference numeral 106 denotes a lip.

As shown in FIGS. 4 to 6, the cooling air passage 105 is provided in plurality radially inside the combustion chamber wall 102, each of the passages 105 being formed into a return flow U-shape turned sideways, the U-shape having ends disposed on the upstream side in the transverse cross-sectional view. Each passage 105 has a first end in which a supply hole 104 is formed as shown in FIG. 5, the supply hole 104 communicating with the outside of the combustion chamber 5, and a second end in which a jet hole 107 is formed as shown in FIG. 6, the jet hole 107 communicating with the inside of the combustion chamber 5.

To state the foregoing differently, the passage 105 includes a first passage 105*a*, a second passage 105*b*, and a third passage 105*c*. Specifically, the first passage 105*a* extends in parallel with an axial direction of the combustor 3 and has the supply hole 104 on a first end side thereof. The second passage 105*b* extends in parallel with the axial direction of the combustor 3 and has the jet hole 107 on a first end side thereof. The third passage 105*c* extends in parallel with a circumferential direction of the combustor 3 and communicates with both a second end side of the first passage 105*a* and a second end side of the second passage 105*b*. In FIG. 6, reference symbol X1 denotes a center point of the jet hole 107, reference symbol X3 denotes a downstream end of the combustion chamber 5, and reference symbol L3 denotes a distance between the center point X1 of the jet hole 107 and the downstream end X3 of the combustion chamber 5.

Reference is made to FIGS. 5 and 6. The compressed air 12 sent under pressure from the downstream side to the upstream side on the outside of the transition piece wall 101 of the transition piece 6 flows into the first passage 105*a* as the cooling air 13 through the supply hole 104 that communicates with the outside of the combustion chamber 5 and flows to the downstream end of the combustion chamber 5 as shown in FIG. 5. The compressed air 12 as the cooling air 13 then flows past the third passage 105*c* to turn back in the second passage 105*b* and flows toward the upstream side as shown in FIG. 6 before jetting from the jet hole 107 into the inside of the combustion chamber 5. The cooling air 13 that has jetted out from the jet hole 107 is guided by the lip 106, thereby flowing along a wall surface of the combustion chamber wall 102 in a direction in which the combustion gas 16 flows.

Figure 7:
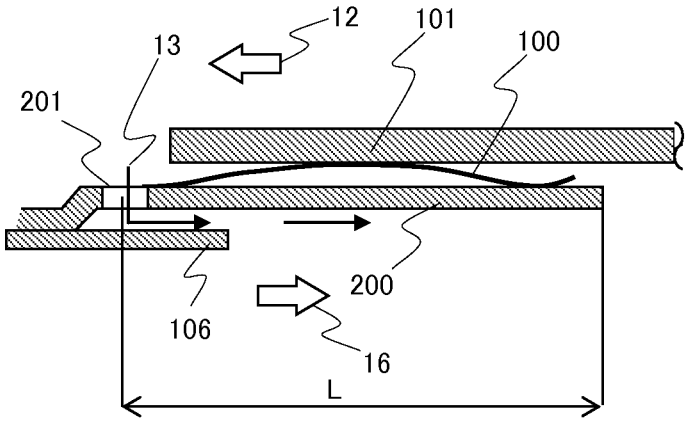
FIG.7 PRIOR ART
FIG. 7 is a longitudinal cross-sectional view showing a combustion chamber and a transition piece that constitute a gas turbine combustor of the related art.

For a comparison with the first embodiment, the following describes with reference to FIG. 7 a combustor having a connection between a combustion chamber 5 and a transition piece 6, the combustion chamber 5 having no passages inside a combustion chamber wall. FIG. 7 is a longitudinal cross-sectional view showing the combustion chamber and the transition piece that constitute a gas turbine combustor of the related art. In FIG. 7, like or corresponding parts as those shown in FIGS. 1 to 6 are identified by the same reference numerals and detailed descriptions for those parts will be omitted.

In FIG. 7, reference numeral 200 denotes a combustion chamber wall of the combustion chamber 5 and reference numeral 201 denotes a cooling hole through which cooling air 13 is introduced into the inside of the combustion chamber 5. The related art shown in FIG. 7 incorporates a film air cooling system for cooling the wall surface of the combustion chamber wall 200. A lip 106 forms in the cooling air 13 that flows in through the cooling hole 201 a flow in a direction along the wall surface of the combustion chamber wall 200.

The related art having the arrangements as described above includes a sealing part 100 disposed on an outer surface of the combustion chamber wall 200 and a transition piece wall 101 that covers the outside of the sealing part 100. In general, compressed air 12 that flows outside the combustion chamber 5 and the transition piece 6 achieves an effect of convection cooling; however, portions of the combustion chamber wall 200 covered by the transition piece wall 101 do not benefit from the convection cooling effect. This necessitates cooling of the portions of the combustion chamber wall 200 only with film cooling.

A distance L between a center of the cooling hole 201 and a combustion chamber wall downstream end is generally formed to be relatively long. Furthermore, because the sealing part 100 and the transition piece wall 101 cover the outside of a portion near the combustion chamber wall downstream end, the cooling hole 201 cannot be formed in the portion. Thus, to enable the film cooling to provide sufficient cooling for the combustion chamber wall 200 up to its downstream end, the cooling hole 201 needs to have a large diameter so as to increase an amount of the cooling air 13. The increase in the amount of the cooling air 13, unfortunately, reduces an amount of combustion air 14, resulting in an increased amount of NOx emissions.

The first embodiment of the present invention provides the following solution to the foregoing problem. Specifically, as shown in FIGS. 4 to 6, the cooling air 13 that flows in via the supply hole 104 flows through the first passage 105*a* formed inside the combustion chamber wall 102 to a position near the downstream end of the combustion chamber 5 toward the direction in which the combustion gas 16 flows. The cooling air 13, after flowing past the third passage 105*c* thereafter, turns back in the second passage 105*b* to thereby flow in a backward direction before jetting out into the inside of the combustion chamber 5 through the jet hole 107. The cooling air 13 that has jetted out from the jet hole 107 is guided by the lip 106, thereby forming a flow flowing in the same direction as the combustion gas 16 along the wall surface of the combustion chamber wall 102.

In the above-described gas turbine combustor according to the first embodiment of the present invention, because of the improved cooling performance of the combustion chamber 5 of the gas turbine combustor 3, the amount of the cooling air 13 can be reduced and the amount of the combustion air 14 can be increased. As a result, the embodiment can provide a highly reliable gas turbine combustor capable of reducing the amount of NOx emissions.

In the gas turbine combustor according to the first embodiment described above, the cooling air 13 passes through the inside of the combustion chamber wall 102. This improves cooling performance because of convection cooling involved. In particular, the third passage 105*c* is formed in the circumferential direction of the combustion chamber 5 at the area near the downstream end of the combustion chamber wall 102, so that the cooling air 13 flows toward the circumferential direction. The area near the downstream end of the combustion chamber wall 102 can thereby be cooled throughout the circumferential direction.

In the gas turbine combustor according to the first embodiment described above, the cooling air 13 jetted from the jet hole 107 into the inside of the combustion chamber 5 can be used as air for film cooling. Specifically, the dual cooling effect can enhance reliability of the combustion chamber 5.

In the gas turbine combustor according to the first embodiment described above, cooling performance equivalent to or greater than that of the related art can be achieved with a small amount of the cooling air 13. The amount of the combustion air 14 can thus be increased. This increase in the amount of the combustion air 14 allows the amount of NOx emissions and the temperature of the combustion gas 16 to be reduced. The reduced temperature of the combustion gas 16 allows reliability of components other than the combustion chamber 5 to be enhanced.

While the first embodiment has been described, by way of example, to include the passages 105, each of the passages 105 being formed into a U-shape turned sideways, the U-shape having ends disposed on the upstream side in the transverse cross-sectional view, the invention is not limited thereto. Any other shape, such as a V-shape and a U-shape, may be used, if such other V-shape or U-shape is a return flow shape that includes a first passage and a second passage, the first passage allowing the cooling air 13 to flow in from the outside upstream of the combustor 3 and to flow through the inside of the combustion chamber wall 102 toward the downstream direction and the second passage allowing the cooling air 13 to turn back toward the upstream direction and having a jet hole on the upstream end side thereof through which the cooling air 13 is jetted to the inside of the combustion chamber 5.

Additionally, the first embodiment has been described, by way of example, to include the passages 105 inside the combustion chamber wall 102 on the downstream end portion of the combustion chamber 5. Understandably, however, the present invention may be applied to any portion other than the downstream end portion of the combustion chamber 5.

Second Embodiment

Figure 8:
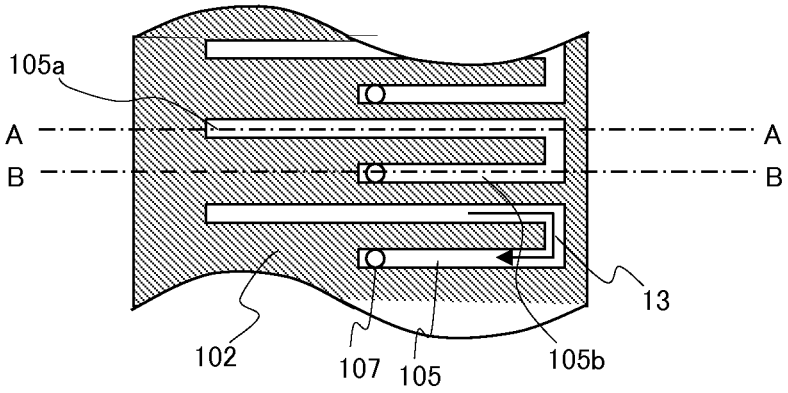
FIG. 8 is a transverse cross-sectional view showing a passage formed at a connection between a combustion chamber and a transition piece that constitute a gas turbine combustor according to a second embodiment of the present invention.
Figure 9:
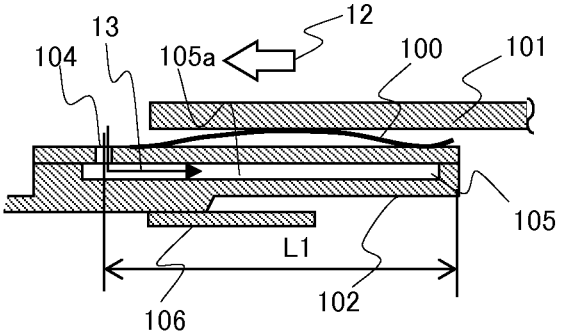
FIG. 9 is a longitudinal cross-sectional view taken along line A-A in FIG. 8, showing the combustion chamber and the transition piece.
Figure 10:
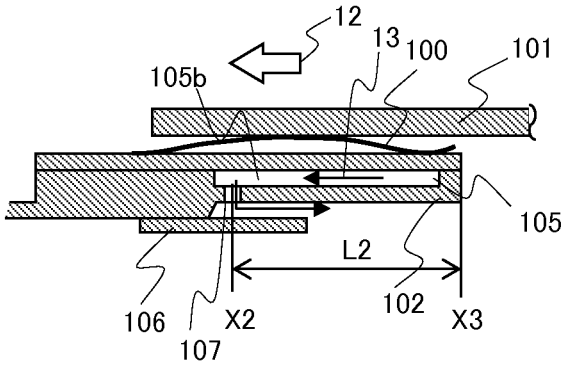
FIG. 10 is a longitudinal cross-sectional view taken along line B-B in FIG. 8, showing the combustion chamber and the transition piece.
Figure 11:
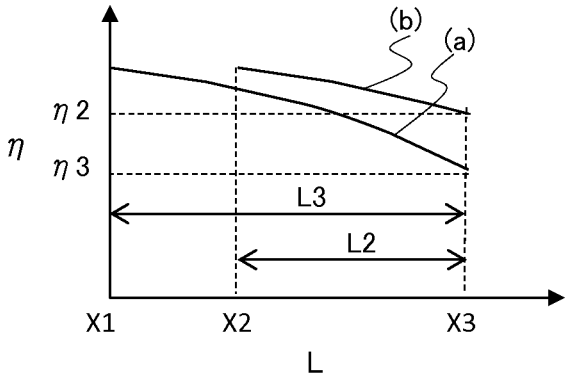
FIG. 11 is a characteristic diagram of cooling efficiency with respect to a length from a jet hole to a downstream end of the combustion chamber that constitutes the gas turbine combustor according to the second embodiment of the present invention.

A gas turbine combustor according to a second embodiment of the present invention will be described below with reference to the relevant accompanying drawings. FIG. 8 is a transverse cross-sectional view showing a passage formed at a connection between a combustion chamber and a transition piece that constitute the gas turbine combustor according to the second embodiment of the present invention. FIG. 9 is a longitudinal cross-sectional view taken along line A-A in FIG. 8, showing the combustion chamber and the transition piece. FIG. 10 is a longitudinal cross-sectional view taken along line B-B in FIG. 8, showing the combustion chamber and the transition piece. FIG. 11 is a characteristic diagram of cooling efficiency with respect to a length from a jet hole to a downstream end of the combustion chamber that constitutes the gas turbine combustor according to the second embodiment of the present invention. In FIGS. 8 to 11, like or corresponding parts as those shown in FIGS. 1 to 7 are identified by the same reference symbols and detailed descriptions for those parts will be omitted.

The gas turbine combustor according to the second embodiment shown in FIGS. 8 to 10 includes elements substantially identical to those of the first embodiment, except for the following. As shown in FIGS. 8 to 10, the gas turbine combustor according to the second embodiment includes a plurality of cooling air passages 105 similar to those in the first embodiment in a combustion chamber wall 102. The second embodiment, however, differs from the first embodiment in the following. Specifically, each of the passages 105 is formed as follows: in a single passage 105, let L1 be a length from a center point of a supply hole 104 formed on a first end side in a first passage 105*a* to a downstream end of a combustion chamber 5 and let L2 be a length from a center point X2 of a jet hole 107 formed on a first end side in a second passage 105*b* to a downstream end X3 of the combustion chamber 5, then L1>L2 holds.

A cooling effect achieved by the second embodiment having the arrangements as described above will be described with reference to FIG. 11. In FIG. 11, the abscissa represents a distance L between the center point of the jet hole 107 and the downstream end X3 of the combustion chamber 5 and X1 represents the center point of the jet hole 107 in the first embodiment shown in FIG. 6. X2 represents the center point of the jet hole 107 in the second embodiment shown in FIG. 10 and X3 represents the downstream end of the combustion chamber 5 shown in FIGS. 6 and 10, respectively. The ordinate represents cooling efficiency. Thus, a characteristic curve (a) indicates a cooling efficiency characteristic in the first embodiment and a characteristic curve (b) indicates a cooling efficiency characteristic in the second embodiment.

Cooling efficiency η is expressed by the following expression (1):

$$\eta = Tg - Tm / Tg - Ta \quad (1)$$

where, Tg is a combustion gas temperature, Tm is a wall surface temperature, and Ta is a cooling air temperature.

In general, the cooling efficiency η exhibits a decreasing trend at longer distances L from the center point of the jet hole 107, given a constant flow rate and a constant temperature of the cooling air. A comparison of the characteristic curve (a) of the first embodiment and the characteristic curve (b) of the second embodiment reveals the following: specifically, because the distance L2 between the center point X2 of the jet hole 107 and the downstream end X3 of the combustion chamber wall 102 in the second embodiment is shorter than the distance L3 in the first embodiment, film cooling efficiency η2 in the second embodiment is higher than film cooling efficiency η3 in the first embodiment at the downstream end X3 of the combustion chamber wall 102.

Thus, the second embodiment yields an effect of enhanced cooling at the downstream end of the combustion chamber wall 102 as compared with the first embodiment. The second embodiment thus can provide a combustor combustion chamber offering greater reliability.

The gas turbine combustor according to the second embodiment of the present invention described above can achieve the same effects as those achieved by the gas turbine combustor according to the first embodiment of the present invention.

The gas turbine combustor according to the second embodiment of the present invention described above, because of its capability of enhancing cooling efficiency at the downstream end position of the combustion chamber wall 102, can provide a highly reliable combustor combustion chamber.

Third Embodiment

Figure 12:
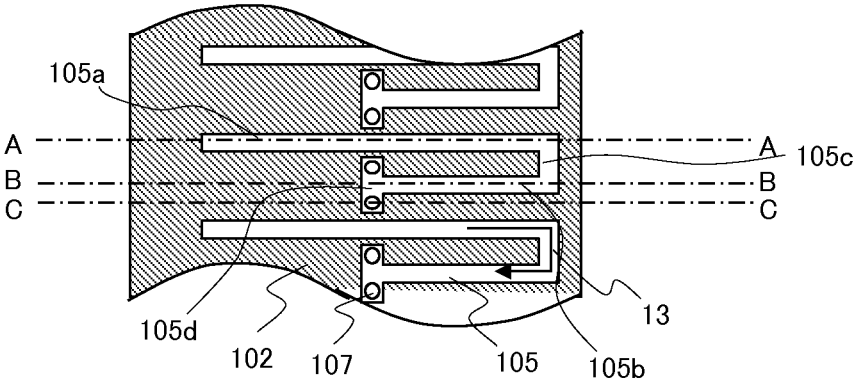
FIG. 12 is a transverse cross-sectional view showing a passage formed at a connection between a combustion chamber and a transition piece that constitute a gas turbine combustor according to a third embodiment of the present invention.
Figure 13:
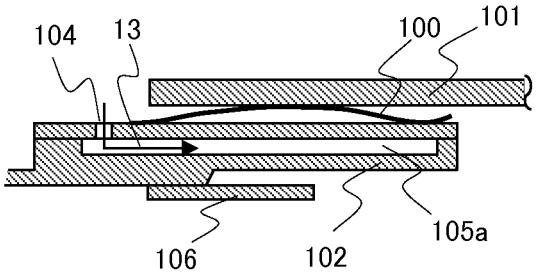
FIG. 13 is a longitudinal cross-sectional view taken along line A-A in FIG. 12, showing the combustion chamber and the transition piece.
Figure 14:
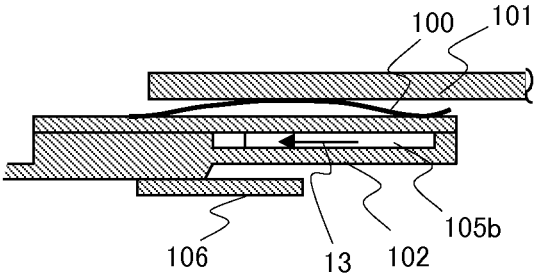
FIG. 14 is a longitudinal cross-sectional view taken along line B-B in FIG. 12, showing the combustion chamber and the transition piece.
Figure 15:
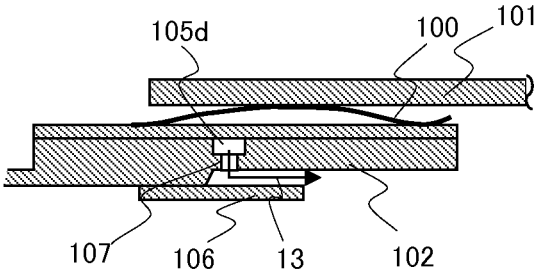
FIG. 15 is a longitudinal cross-sectional view taken along line C-C in FIG. 12, showing the combustion chamber and the transition piece.

A gas turbine combustor according to a third embodiment of the present invention will be described below with reference to the relevant accompanying drawings. FIG. 12 is a transverse cross-sectional view showing a passage formed at a connection between a combustion chamber and a transition piece that constitute the gas turbine combustor according to the third embodiment of the present invention. FIG. 13 is a longitudinal cross-sectional view taken along line A-A in FIG. 12, showing the combustion chamber and the transition piece. FIG. 14 is a longitudinal cross-sectional view taken along line B-B in FIG. 12, showing the combustion chamber and the transition piece. FIG. 15 is a longitudinal cross-sectional view taken along line C-C in FIG. 12, showing the combustion chamber and the transition piece. In FIGS. 12 to 15, like or corresponding parts as those shown in FIGS. 1 to 11 are identified by the same reference symbols and detailed descriptions for those parts will be omitted.

The gas turbine combustor according to the third embodiment of the present invention shown in FIGS. 12 to 15 is configured to include substantially similar elements to those included in the first and second embodiments. The third embodiment differs from the first and second embodiments in the following. Specifically, as shown in FIGS. 12 to 15, the gas turbine combustor according to the third embodiment includes a plurality of cooling air passages 105 similar to those in the second embodiment in a combustion chamber wall 102. The third embodiment, however, differs in that each of the passages 105 is formed as follows: a single passage 105 includes a fourth passage 105*d* disposed at an upstream side end portion of a second passage 105*b* on the side of a jet hole 107, the fourth passage 105*d* extending in a radial direction of the combustion chamber wall 102. Additionally, the fourth passage 105*d* has jet holes 107 formed at both ends thereof.

A first one of the jet holes 107 is disposed radially between a first passage 105*a* and the second passage 105*b*, the first passage 105*a* and the second passage 105*b* extending in an axial direction of the combustion chamber wall 102. A second one of the jet holes 107 is disposed radially between the second passage 105*b* that extends in the axial direction of the combustion chamber wall 102 and the first passage 105*a* of another passage 105 adjacent to the second passage 105*b*.

In the third embodiment having the arrangements as described above, the first passage 105*a* and the second passage 105*b* shown in FIGS. 13 and 14, respectively, can yield a convection cooling effect because of the cooling air 13 flowing therethrough. In addition, the cooling air 13 that jets out from the jet holes 107 on both ends of the fourth passage 105*d* shown in FIGS. 12 and 15 flows along an inner periphery of the combustion chamber wall 102 as film cooling air among the passages 105 that extend in the axial direction of the combustion chamber 5. Effects of both the convection cooling and the film cooling cool the combustion chamber wall 102 throughout its entire periphery. As a result, distribution of wall surface temperatures in the circumferential direction of the combustion chamber wall 102 is small, so that a combustor combustion chamber offering even greater reliability can be provided.

The gas turbine combustor according to the third embodiment of the present invention described above can achieve the same effects as those achieved by the first embodiment.

The gas turbine combustor according to the third embodiment of the present invention described above can cool the combustion chamber wall 102 throughout its entire periphery with the effects of both the convection cooling and the film cooling. As a result, distribution of wall surface temperatures in the circumferential direction of the combustion chamber wall 102 is small, so that a combustor combustion chamber offering even greater reliability can be provided.

Fourth Embodiment

Figure 16:
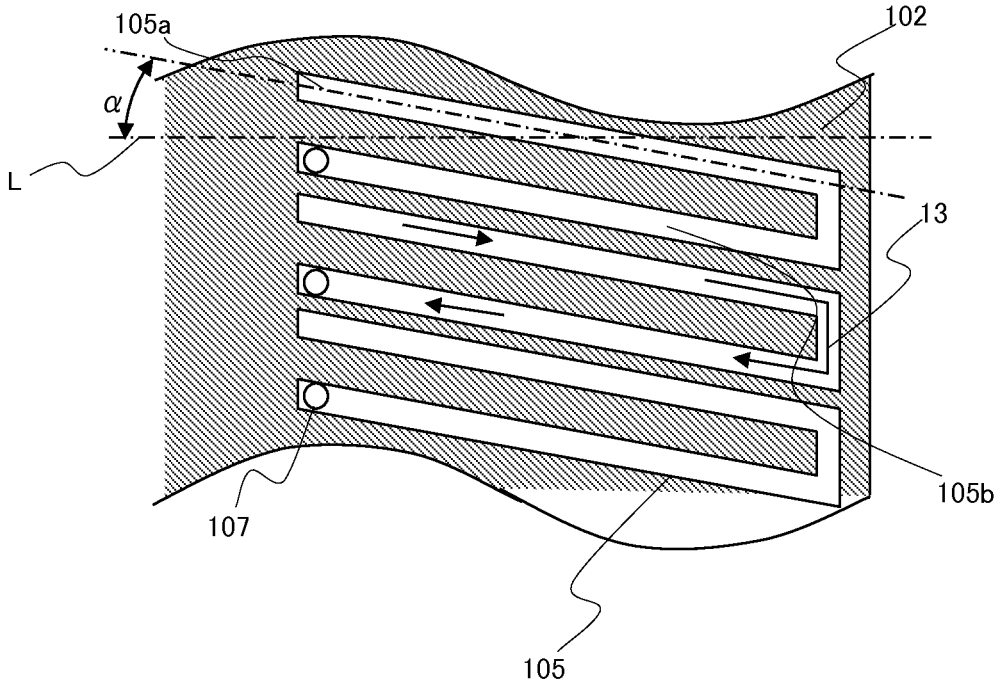
FIG. 16 is a transverse cross-sectional view showing a passage formed at a connection between a combustion chamber and a transition piece that constitute a gas turbine combustor according to a fourth embodiment of the present invention.

A gas turbine combustor according to a fourth embodiment of the present invention will be described below with reference to the relevant accompanying drawings. FIG. 16 is a transverse cross-sectional view showing a passage formed at a connection between a combustion chamber and a transition piece that constitute the gas turbine combustor according to the fourth embodiment of the present invention. In FIG. 16, like or corresponding parts as those shown in FIGS. 1 to 15 are identified by the same reference symbols and detailed descriptions for those parts will be omitted.

The gas turbine combustor according to the fourth embodiment of the present invention shown in FIG. 16 is configured to include substantially similar elements to those included in the first embodiment. The fourth embodiment differs from the first embodiment in the following. Specifically, as shown in FIG. 16, the gas turbine combustor according to the fourth embodiment includes a plurality of cooling air passages 105 similar to those in the first embodiment in a combustion chamber wall 102. The fourth embodiment, however, differs in that a first passage 105*a* and a second passage 105*b* are inclined radially by $\alpha°$ with respect to an axis L of a combustion chamber 5.

In the fourth embodiment having the arrangements as described above, the passages 105 are formed to be inclined radially with respect to the axis L of the combustion chamber 5. Thus, the convection cooling effect by cooling air 13 that flows through the passages 105 allows the combustion chamber wall 102 to be cooled throughout its entire periphery. This reduces the distribution of wall surface temperatures in the circumferential direction of the combustion chamber wall 102, so that a combustor combustion chamber offering even greater reliability can be provided.

The gas turbine combustor according to the fourth embodiment of the present invention described above can achieve the same effects as those achieved by the first embodiment.

The gas turbine combustor according to the fourth embodiment of the present invention described above can cool the combustion chamber wall 102 throughout its entire periphery. As a result, the distribution of wall surface temperatures in the circumferential direction of the combustion chamber wall 102 can be reduced, so that a combustor combustion chamber offering even greater reliability can be provided.

The present invention is not limited to the described first to fourth embodiments and various modifications are included therein. The foregoing embodiments are those described in detail to explain the present invention clearly and the invention is not necessarily limited to those including all components described. For example, a part of the configuration of an embodiment can be replaced by the configuration of another embodiment. To the configuration of an embodiment, the configuration of another embodiment can be added. As for a part of the configuration of each embodiment, another configuration can be added to it or it can be removed and replaced by another configuration.

What is claimed is:

1. A gas turbine combustor comprising:

a cylindrical combustion chamber that burns combustion air and fuel to thereby produce combustion gas;

an outer casing disposed concentrically on an outside of the cylindrical combustion chamber;

an end cover disposed at an upstream side end portion of the outer casing;

an annular passage formed by an outer peripheral surface of the cylindrical combustion chamber and an inner peripheral surface of the outer casing, the annular passage allowing the combustion air to flow therethrough; and a passage formed inside a combustion chamber wall between the outer peripheral surface and an inner peripheral surface of the cylindrical combustion chamber, the passage having a U-shape along a circumferential direction of the cylindrical combustion chamber and having ends disposed on an upstream side in a transverse cross-sectional view; and a transition piece disposed on a downstream side of the combustion chamber, the transition piece receiving a downstream end of the combustion chamber fitted therewith so as to be internally inserted therein, and a passage structure, in communication with the combustion air, including the passage, the passage further comprising a first passage and a second passage, wherein the first passage and the second passage are formed on a single circumferential plane inside the combustion chamber wall on the downstream end of the combustion chamber internally inserted into the transition piece, wherein the first passage extends in parallel with an axial direction of the combustion chamber and has a supply hole on a first end side of the first passage, the supply hole communicating with an outside of the combustion chamber wall, and the second passage communicating with a second end side of the first passage and has a jet hole on a first end side of the second passage, the jet hole communicating with an inside of the combustion chamber wall, and part of the combustion air enters the supply hole and flows through the first passage in a direction identical to a flow direction of the combustion gas and thereafter turns back in the second passage to thereby flow in a direction opposite to the flow direction of the combustion gas before jetting out into the inside of the combustion chamber through the jet hole.

2. The gas turbine combustor according to claim 1, wherein the first passage of the passages has a length longer than a length of the second passage.

3. The gas turbine combustor according to claim 1, wherein the jet hole is formed radially in the combustion chamber between the first passage through which part of the combustion air that has flowed in through the supply hole flows in the direction identical to the flow direction of the combustion gas and the second passage through which the part of the combustion air that has flowed in through the supply hole turns back to thereby flow in the direction opposite to the flow direction of the combustion gas.

4. The gas turbine combustor according to claim 1, wherein the first passage and the second passage are formed to be inclined obliquely with respect to the axial direction of the combustion chamber.

5. The gas turbine combustor according to claim 1, further comprising:

a plurality of passage structures formed in a circumferential direction inside the combustion chamber wall, each of the passage structures including the passage having the first passage and the second passage and allowing part of the combustion air to flow therethrough.

* * * * *